US009085165B2

(12) United States Patent
Kinoshita et al.

(10) Patent No.: US 9,085,165 B2
(45) Date of Patent: Jul. 21, 2015

(54) LIQUID EJECTING HEAD AND LIQUID EJECTING APPARATUS

(71) Applicant: SEIKO EPSON CORPORATION, Tokyo (JP)

(72) Inventors: Ryota Kinoshita, Matsumoto (JP); Shunsuke Watanabe, Matsumoto (JP); Katsumi Enomoto, Kanagawa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/213,850

(22) Filed: Mar. 14, 2014

(65) Prior Publication Data

US 2014/0292953 A1 Oct. 2, 2014

(30) Foreign Application Priority Data

Mar. 27, 2013 (JP) ..... 2013-067437
Aug. 5, 2013 (JP) ..... 2013-162000
Feb. 28, 2014 (JP) ..... 2014-037976

(51) Int. Cl.

| | |
|---|---|
| ***B41J 2/05*** | (2006.01) |
| ***B41J 2/175*** | (2006.01) |
| ***B41J 2/14*** | (2006.01) |
| ***B41J 2/16*** | (2006.01) |
| ***B41J 2/165*** | (2006.01) |

(52) U.S. Cl.

CPC .. *B41J 2/175* (2013.01); *B41J 2/14* (2013.01); *B41J 2/16* (2013.01); *B41J 2/16505* (2013.01)

(58) Field of Classification Search

USPC ..... 347/65, 66, 85
See application file for complete search history.

(56) References Cited

U.S. PATENT DOCUMENTS

| | | | | |
|---|---|---|---|---|
| 6,481,834 | B2 * | 11/2002 | Takahashi et al. | 347/68 |
| 7,465,039 | B2 * | 12/2008 | Enomoto et al. | 347/68 |
| 8,511,784 | B2 * | 8/2013 | Zhang | 347/17 |
| 8,550,598 | B2 * | 10/2013 | Owaki | 347/49 |
| 2011/0279546 | A1 | 11/2011 | Kihara et al. | |
| 2013/0025701 | A1 | 1/2013 | Suzuki et al. | |

FOREIGN PATENT DOCUMENTS

JP 2011-056872 3/2011

OTHER PUBLICATIONS

European Search Report for Application No. 14161031.1 dated Jul. 7, 2014.

* cited by examiner

*Primary Examiner* — Anh T. N. Vo
(74) *Attorney, Agent, or Firm* — Workman Nydegger

(57) ABSTRACT

A liquid ejecting head includes a flow path portion that has a first communication path, a case member that has a second communication path, a seal member that is pinched between the case member and the flow path portion, and a cover member to which a head chip that discharges the liquid from a nozzle communicating with the second communication path is set. An opening that has a predetermined space formed inside is formed on a recording medium side of the case member. The cover member covers the opening in a state where the head chip is arranged in the predetermined space and the nozzle is exposed to an outside. The seal member allows the first communication path and the second communication path to be connected in a liquid-tight manner and seals the predetermined space on a case member side.

16 Claims, 13 Drawing Sheets

LIQUID EJECTING HEAD AND LIQUID EJECTING APPARATUS

BACKGROUND

1. Technical Field

The present invention relates to a liquid ejecting head that ejects a liquid such as ink from a nozzle, and to a liquid ejecting apparatus.

2. Related Art

An ink jet type recording head (that is a representative example of a liquid ejecting head which ejects liquid drops) includes a pressure generation chamber that communicates with a nozzle and a piezoelectric actuator which is disposed to face the pressure generation chamber, A pressure change is generated in the pressure generation chamber by a displacement of the piezoelectric actuator so that the ink drops are ejected from the nozzle.

Various structures have been proposed as the structure of such ink jet type recording heads. In general, a plurality of members are set by using an adhesive or the like (for example, refer to JP-A-2011-56872).

In a structure of the ink jet type recording head shown in JP-A-2011-56872, a seal structure is provided in which a planar seal member is interposed between two flow path members.

In a case where a head chip that is small in size is employed, the absolute amount of ink that is held therein is small and thus an effect from thickening of the ink caused by drying becomes significant. In JP-A-2011-56872, the seal structure that serves as a flow path joint does not have a function of sealing the head chip. When a case seal and a flow path joint seal are separately disposed, an increase in size is caused and attachment workability is reduced.

Such disadvantages are present not only in ink jet type recording heads that eject ink but also in various liquid ejecting heads and liquid ejecting apparatuses.

SUMMARY

An advantage of some aspects of the invention is to provide a liquid ejecting head with which an element of a liquid such as ink is unlikely to be evaporated, and a liquid ejecting apparatus.

According to an aspect of the invention, a liquid ejecting head includes a flow path portion that has a first communication path which allows a liquid from a liquid holding unit to pass, a case member that has a second communication path which communicates with the first communication path, a seal member that is pinched between the case member and the flow path portion, and a cover member to which a head chip that discharges the liquid from a nozzle communicating with the second communication path is set, in which an opening that has a predetermined space formed inside is formed on a recording medium side of the case member, the cover member covers the opening in a state where the head chip is arranged in the predetermined space and the nozzle is exposed to an outside, and the seal member allows the first communication path and the second communication path to be connected in a liquid-tight manner and seals the predetermined space on a case member side.

According to another aspect of the invention, a liquid ejecting apparatus includes the liquid ejecting head.

In the above-described aspect, the opening that has the predetermined space formed inside is formed on the recording medium side of the case member of the liquid ejecting head. The cover member covers the opening in a state where the head chip is arranged in the predetermined space and the nozzle is exposed to the outside. The first communication path of the flow path portion and the second communication path of the case member are connected in a liquid-tight state and the predetermined space on the case member is sealed by the seal member that is interposed between the case member and the flow path portion.

According to the above-described aspect, the head chip is arranged in the predetermined space that is blocked, and the predetermined space is sealed by the seal member that allows the first and second communication paths to be connected in a liquid-tight manner. As such, according to the above-described aspect, an element of a liquid such as ink is unlikely to be evaporated, and a discharge error caused by thickening of the liquid can be suppressed.

As such, a case member seal and a flow path joint seal can be constituted by the same seal member, and the vicinity of the head chip can be surrounded by a seal structure. Accordingly, the evaporation of the element contained in the liquid such as the ink, for example moisture, can be suppressed and a space-saving effect and an effect of a reduced number of components can be expected.

Herein, connection between a first flow path and a second flow path means both direct linking between the first flow path and the second flow path and, further, indirect linking between the first flow path and the second flow path via another flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail. The following embodiment is just an example of the invention, and the drawings are just examples of the invention.

Figure 1:
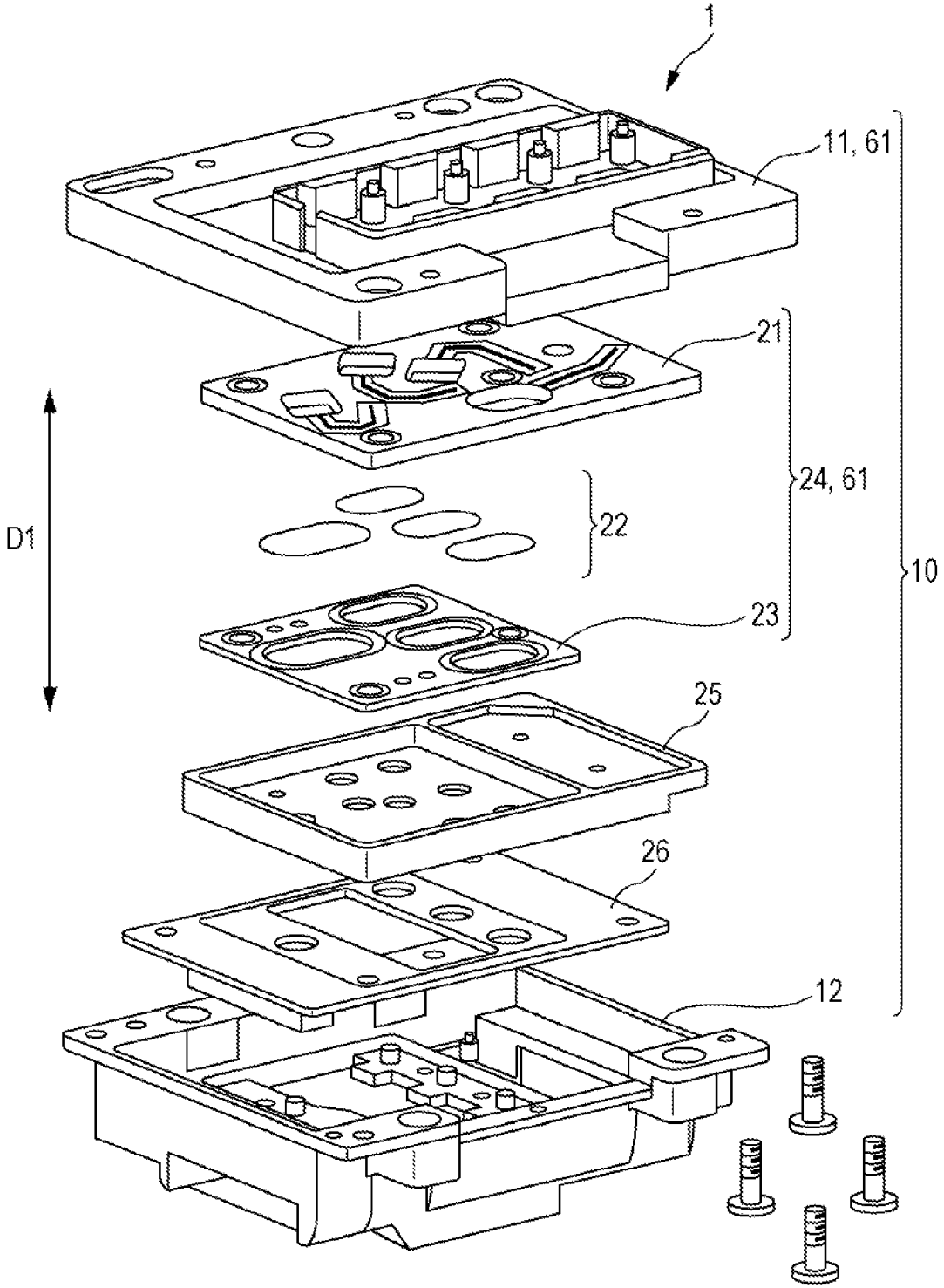
FIG. 1 is a development view of an upper side of a liquid ejecting head.
Figure 2:
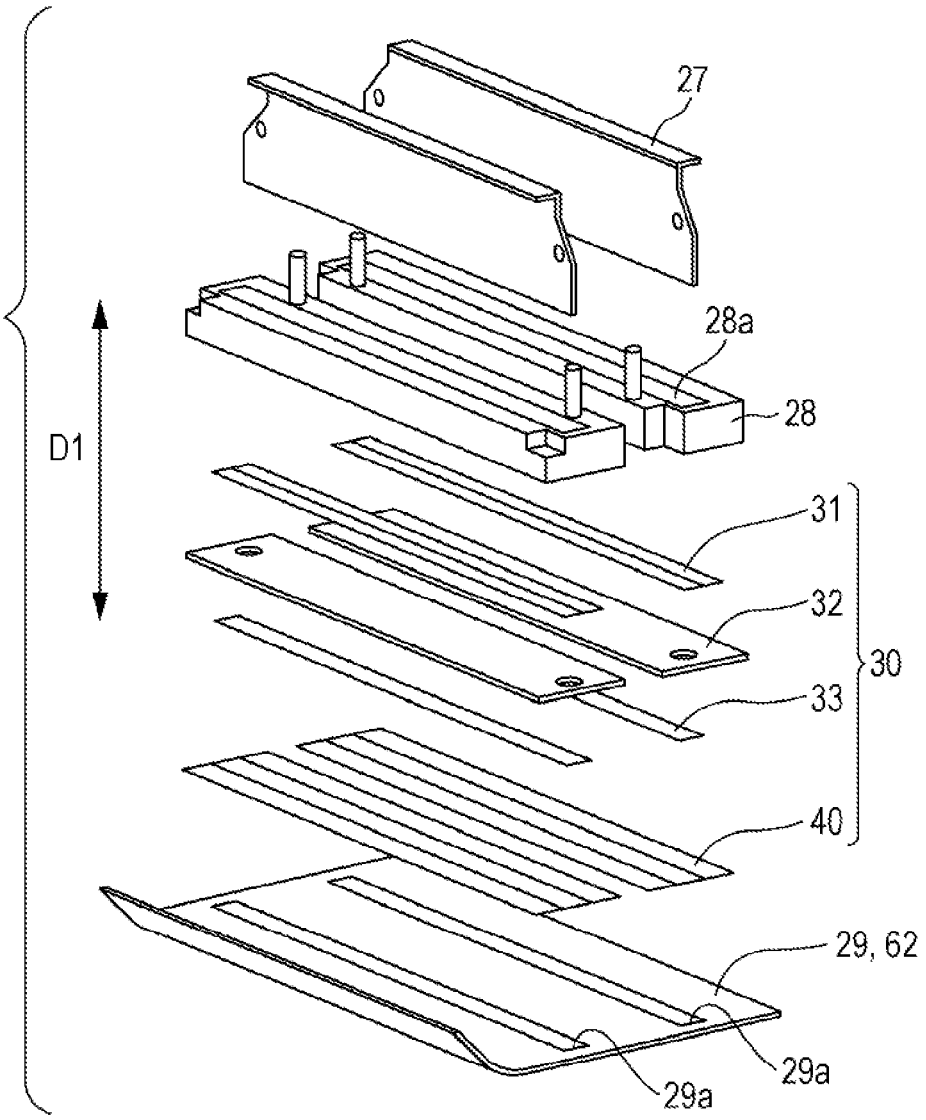
FIG. 2 is a development view of a lower side of the liquid ejecting head.
Figure 3:
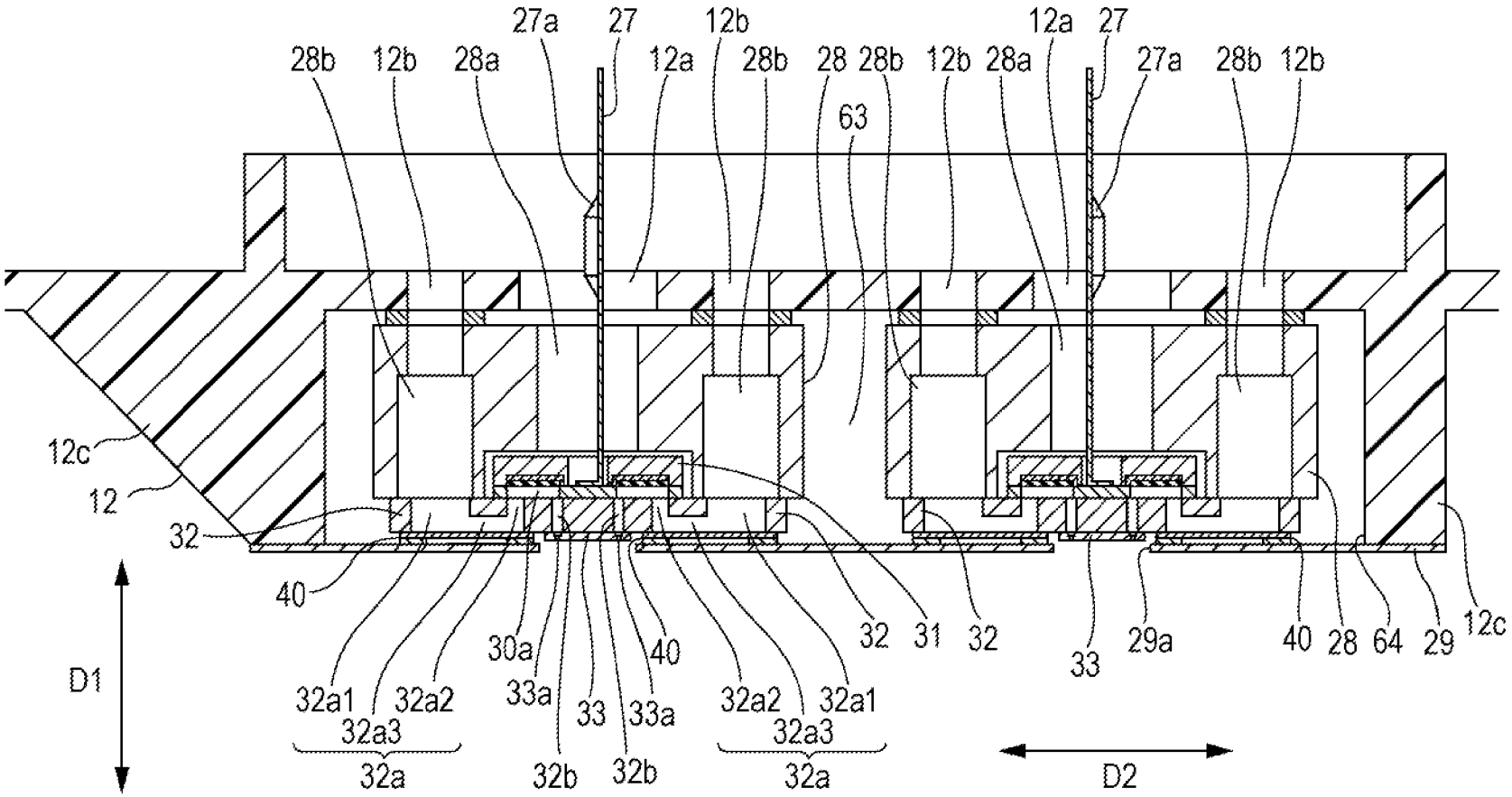
FIG. 3 is a cross-sectional view of a head chip and the vicinity thereof.

FIGS. 1 and 2 are development views of an ink jet type recording head 1 showing an example of a liquid ejecting head according to the embodiment of the invention. FIG. 3 is a cross-sectional view of a head chip 30 of the ink jet type recording head 1 and the vicinity thereof.

As shown in FIGS. 1 and 2, an ink jet type recording head 1 is formed by accommodating respective parts in an upper and lower case member 10 that has an upper case member 11 and a lower case member 12. An upper space and a lower space are formed in the lower case member 12. A flow path member 24 (that has a first flow path member 21, a filter 22, and a second flow path member 23), a seal member 25, and a circuit substrate 26 are sequentially stacked from above and are accommodated in the upper space. The flow path member 24 and the upper case member 11 are provided in a flow path portion 61 that has a first communication path 24*a* (refer to FIG. 8) which allows ink (liquid) from ink cartridges (liquid holding units) 221 and 222 (refer to FIG. 16) to flow.

Also, a part of a flexible substrate 27, a manifold member (third flow path member) 28, a piezoelectric actuator part 31, a flow path forming plate 32, a nozzle plate 33, a compliance member 40, and a cover member 29 are accommodated from above in the lower space. The head chip 30 shown in FIG. 2 is a concept including the piezoelectric actuator part 31, the flow path forming plate 32, the nozzle plate 33, and the compliance member 40. In addition, the cover member 29 to which the head chip 30 is set is provided in a cover member 62.

The head chip 30 has a function of discharging the ink from a nozzle 33*a* that communicates with a case member communication path (second communication path) 12*b* (refer to FIG. 8) of the lower case member 12. In the head chip 30 shown in FIG. 2, the piezoelectric actuator part 31 is fixed to an upper surface of the flow path forming plate 32, and the nozzle plate 33 and the compliance member 40 are fixed to a lower surface thereof. The flow path forming plate 32 is formed into a substantially rectangular plate shape. The piezoelectric actuator part 31 (which is formed into a substantially strip shape) is set on the upper surface of a central part of respective path forming plates 32 in a short direction. The piezoelectric actuator part 31 has pressure chambers 30*a* that are open downward. A ceiling wall of the pressure chamber 30*a* is bent in an up-down direction to allow a pressure change to be generated in the pressure chamber 30*a*. The pressure chamber 30*a* is formed in a pressure chamber substrate 31*a*. The pressure chamber substrate 31*a* may be made of silicon.

An elastic membrane, an insulator film, and individual piezoelectric actuators (each of which having a first electrode, a piezoelectric body layer, and a second electrode) are formed in the ceiling wall of the pressure chamber 30*a*. In this context, the piezoelectric actuator part 31 refers to an integrated part in which a required number of the individual piezoelectric actuators are formed. Also, in this embodiment, the first electrode functions as an individual electrode that is independent of each of the piezoelectric actuators, and the second electrode functions as a common electrode that is common to a plurality of the piezoelectric actuators. Also, the first electrode is connected to one end of a lead electrode. A drive circuit 27*a* (which is formed on the flexible substrate 27) is connected to the other end of the lead electrode. Protective films may be formed in terminals in a predetermined space 63 such as the first electrode, the second electrode, and the lead electrode. A chip on film (COF) or the like that is covered by a plastic film is used in the flexible substrate 27. A liquid flow path such as the pressure chamber 30*a* is present in the vicinity of the piezoelectric actuator, and thus moisture is likely to be evaporated from the vicinity of the piezoelectric actuator.

As described above, the flexible substrate is used for electrical connection with the piezoelectric actuator. However, it is not easy to isolate the flexible substrate from the outside during sealing to thereby suppress the moisture evaporation from the ink. This head 1 realizes the removal of electrical wiring from the flexible substrate, which is difficult to be sealed.

The two pressure chambers 30*a* and 30*a* are formed in the short direction, and a predetermined number thereof are formed in two rows, lined up in a longitudinal direction. The flexible substrate 27 that extends in the longitudinal direction is connected to a gap in the center between the two pressure chambers 30*a* and 30*a* which are lined up in the short direction. The flexible substrate 27 supplies driving power to the individual piezoelectric actuators of the two rows of the pressure chambers 30*a* and 30*a* which are positioned on both sides as described above. Each of the pressure chambers 30*a* faces a flow path 32*a* and a nozzle hole 32*b* that are formed on the flow path forming plate 32 on a lower surface thereof. Ink (which is a discharge liquid (liquid)), is supplied from a flow path 32*a* side to the pressure chamber 30*a*, and the ink is pushed to a nozzle hole 32*b* side by the pressure change. The nozzle holes 32*b* and 32*b* are also arranged in a row, formed in two rows, in a longitudinal direction in the center of the short direction to correspond to the two rows of the pressure chambers 30*a*. Likewise, two rows of the flow paths 32*a* and 32*a* are formed on a short-direction outer side, arranged in a row. The pressure chamber substrate 31*a* is set in a liquid-tight manner by an adhesive or the like on the flow path forming plate 32. Being liquid-tight means a state where a liquid does not leak.

A flow path 32*a*1 and a flow path 32*a*3 of the flow path forming plate 32 are common communication paths, and a flow path 32*a*2 is an individual communication path. The upper surface is open at an outer-side inlet 32*a*1 and an inner-side outlet 32*a*2, and both thereof communicate with each other at the central flow path 32*a*3 that is open to the lower surface. The central flow path 32*a*3 is open on the short-direction outer side of the nozzle hole 32*b*, and thus the elongated central flow paths 32*a*3 and 32*a*3 are open to the outer side and the two nozzle holes 32*b* and 32*b* are open to the inner side thereof when the flow path forming plate 32 is viewed from below. These are formed to be lined up in the longitudinal direction. The flow path forming plate 32 may be made of silicon.

The nozzle plate 33 is formed into a strip-like rectangular shape that extends in the longitudinal direction along the positions where the nozzle holes 32*b* and 32*b* of the flow path forming plate 32 are formed, and two nozzles 33*a* and 33*a* are formed to face the two nozzle holes 32*b* and 32*b*. The ink that is pushed to the nozzle hole 32*b* side by the pressure change in the pressure chamber 30*a* is discharged outside from the nozzle 33*a*. In other words, the liquid drops are discharged. The nozzle plate 33 is formed of an expensive silicon material. The nozzle 33*a* that is formed on the nozzle plate 33 is oriented downward.

The nozzle plate 33 is attached to the path forming plate 22 so as to be open along the positions where the nozzle holes 32*b* and 32*b* are formed, and thus the central flow paths 32*a*3 and 32*a*3 which are formed in two rows on an outer side thereof remain open. The nozzle plate 22 is covered by the compliance member 40.

Figure 4:
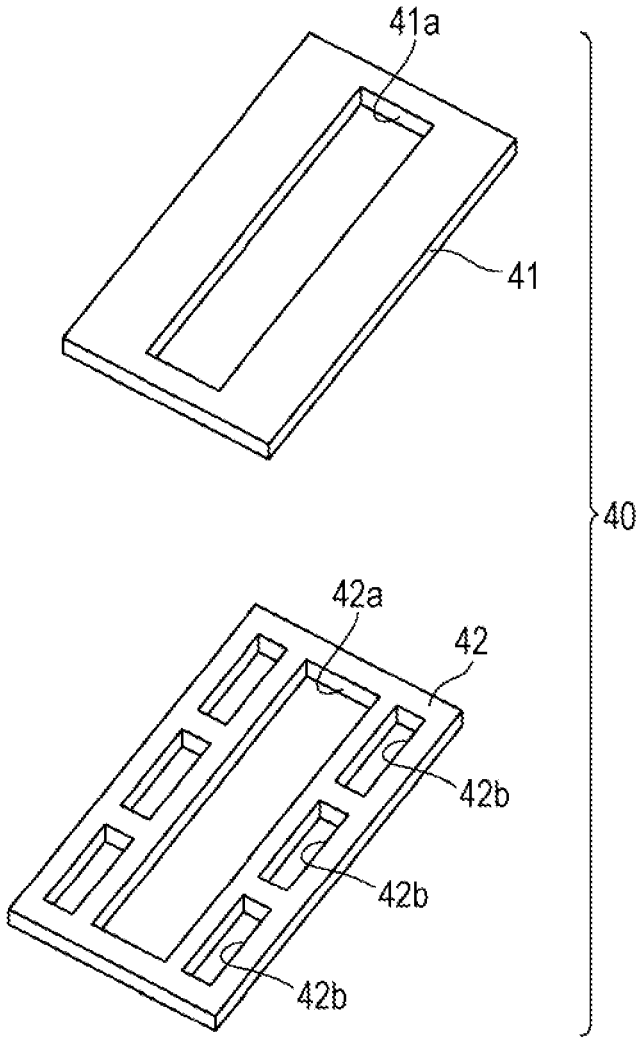
FIG. 4 is a schematic development view showing a configuration of a compliance member.

FIG. 4 is a schematic development view showing a configuration of the compliance member. The compliance member 40 is configured to have an elastic membrane 41 that is an elastic membrane member, and a frame material 42 that is a supporting body. The elastic membrane 41 may be formed of a resin film that is a resin film member. Further, the frame material 42 may be made of stainless steel. The frame material 42 has a rectangular cut-out portion 42*a* in the center so as not to interfere with the nozzle plate 33, and two rows of three window sections 42*b* are formed to correspond to parts where the two rows of the central flow paths 32*a*3 and 32*a*3 are formed. The elastic membrane 41 is supported by a frame portion of the frame material 42 by attaching the elastic membrane 41 where a cut-out portion 41*a* is formed at a similar position to the cut-out portion 42*a*. Through the attachment from an elastic membrane 41 side to the lower surface of the flow path forming plate 32, each of the central flow paths 32*a*3 is sealed by the elastic membrane 41. The window section 42*b* of the frame material 42 is formed on the side opposite to the elastic membrane 41, and the elastic membrane 41 can be flexurally deformed by the same amount as the thickness of the window section 42*b*. Also, a groove is formed in a part of the frame material 42 and a passage leading to the atmosphere is provided so that the window section 42*b* is not sealed, and thus the elastic membrane 41 is likely to be deformed. Accordingly, the compliance member 40 forms a series of communication paths by covering the central flow path 32*a*3 that reaches the outlet 32*a*2 from the inlet 32*a*1 from below, and achieves a function as the compliance member during the course thereof. A position where the compliance member 40 is mounted is not limited to the lower surface of the flow path forming plate 32, but may be the vicinity of the outlet 32*a*2 side. In this case, the central flow path 32*a*3 may be blocked by another member to form only the communication path and may maintain the function as the compliance member at the other part.

A wall-shaped enclosure 12*c* (that forms the predetermined space 63 which can accommodate the head chip 30 and the manifold member 28) is formed in a projecting manner at a lower end of the lower case member 12. The wall-shaped enclosure 12*c* projects in a cylindrical shape to form the space 63 inside, and is formed to have a thickness larger than the thickness of the other wall surface of the lower case member 12. Since a cylindrical thick part is formed at the lower end of the lower case member 12, the lower case member 12 is unlikely to be bent in general, particularly around the wall-shaped enclosure 12*c* and a part where the wall-shaped enclosure 12*c* is disposed. Preferably, the wall-shaped enclosure 12*c* has a substantially square shape and a continuously linked cylindrical shape, but may not necessarily have the continuously linked shape. In other words, the wall-shaped enclosure 12*c* is effective in suppressing deformation or the like based on bending if disposed in a projecting manner through integral molding with the lower case member 12 so as to form a predetermined space inside.

The cover member 29 formed of stainless steel that is thin enough to have elasticity) is fixed to and covers an opening 64 that is formed in a projecting end section which is a top of the wall-shaped enclosure 12*c*. In the cover member 29, an elongated opening 29*a* that exposes the nozzle plate 33 to the lower surface is formed in a planar section along a printing medium (recording medium). Herein, the head chip 30 and the cover member 29 are attached to and set in a compliance member 40 part of the head chip 30 in the planar section in the vicinity of the opening 29*a* of the cover member 29. That is, the cover member 20 is not attached to and set in a nozzle plate 33 part of the head chip 30 that constitutes an ink flow passage.

Also, the head chip 30 is fixed to a lower part of the lower case member 12 via the manifold member 28. A through port 28*a* (which extends in a longitudinal direction) is formed in the center of the manifold member 28. The flexible substrate 27 is inserted via the through port 28*a*. The manifold member 28 has a space formed in the vicinity of a lower-side opening of the through port 28*a* so as to be capable of accommodating the piezoelectric actuator part 31. The manifold member 28 also has a communication path 28*b* formed from an upper surface through a lower surface in a part other than the through port 28*a* so as to face the inlet 32*a*1 of the flow path 32*a* of the flow path forming plate 32. The manifold member 28 and the flow path forming plate 32 are attached in a liquid-tight manner by an adhesive. According to the above-described configuration, communication is made from the communication path 28*b* to the pressure chamber 30*a* through the flow path 32*a* and, further, a series of ink passages are formed that lead to the nozzle 33*a* via the nozzle hole 32*b*. The manifold member 28 may be a member which is molded of a thermoplastic resin, for example, an acrylic resin, ABS resin, polyethylene.

The lower case member 12 has a through-hole 12*a* and a case member communication path 12*b* formed to correspond to the through port 28*a* and the communication path 28*b* of the manifold member 28. The manifold member 28 is fixed to the lower case member 12 from below the lower case member 12 by a flexible adhesive, which will be described later. In this case, the communication path 28*b* and the case member communication path 12*b* are set in such a manner as to be connected in a liquid-tight manner.

In this manner, the head chip 30 and the manifold member 28 that are disposed in the space of the lower case member 12 (which is unlikely to be bent) are unlikely to be subjected to an external force. Further, the cover member 29 having elasticity absorbs torsion generated between the head chip 30 and the lower case member 12 so that the head chip 30 is even more unlikely to be subjected to the external force. As such, peeling by the members that constitute the head chip 30 can be suppressed and, in addition, ink leakage can be suppressed. Further, an adhesive having flexibility is even more effective during the fixing of the head chip 30 and the manifold member 28 (i.e., the members that constitute the ink flow passage). Such adhesive may be silicon-based adhesive or modified epoxy-based adhesive.

The position of the wall-shaped enclosure 12*c* where the cover member 29 is fixed is not limited to the opening on the top of the wall-shaped enclosure 12*c* as described above, but may be inner and outer side surfaces of the wall-shaped enclosure 12*c*. Also, the material of the cover member 29 is not limited to stainless steel, but the cover member 29 may be a member having elasticity. Further, the head chip may be set in the cover member, and setting of the head chip with the manifold member is just an example. The configuration of the ink flow path from the case member communication path (second communication path) toward the nozzle with the manifold member or the like is just an example as well.

The nozzle plate 33 is formed to be thinner than the compliance member 40. Accordingly, the nozzle plate 33 has a positional relationship of not projecting to a further outer side than the cover member 29 when positioned in the opening 29*a*. Also, the nozzle plate 33 that is formed of silicon with high precision is expensive, and thus is attached in such a manner as to cover only a necessary part so as to be small in size and exposure from the opening 29*a* of the cover member 29 is suppressed to a minimum. The head chip 30 and the cover member 29 are attached to and set in the planar section in the vicinity of the opening 29*a* of the cover member 29 not in a part of the nozzle plate 33 but in a part of the compliance member 40.

In this manner, in the nozzle plate 33 that constitutes the ink flow passage of the head chip 30, a possibility of contact with the printing medium is suppressed to a minimum. Further, the printing medium is in contact with the cover member 29 that does not constitute the ink flow passage. As such, peeling in the member that constitutes the ink flow passage can be suppressed and, in addition, ink leakage can be suppressed.

Figure 5:
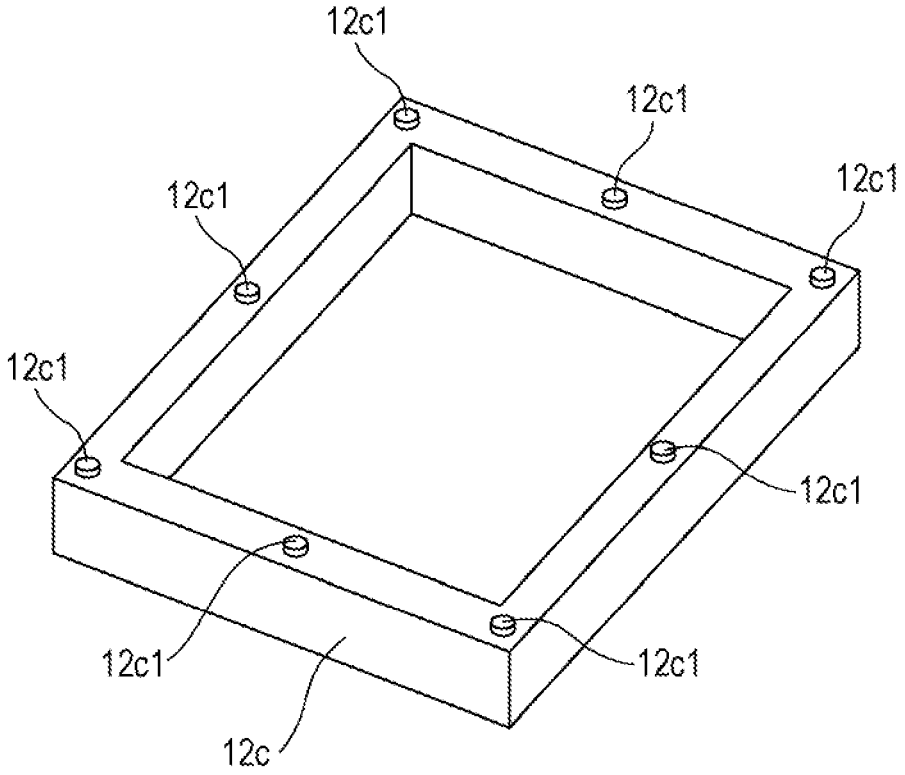
FIG. 5 is a schematic perspective view showing a bottom side of a case member.
Figure 6:
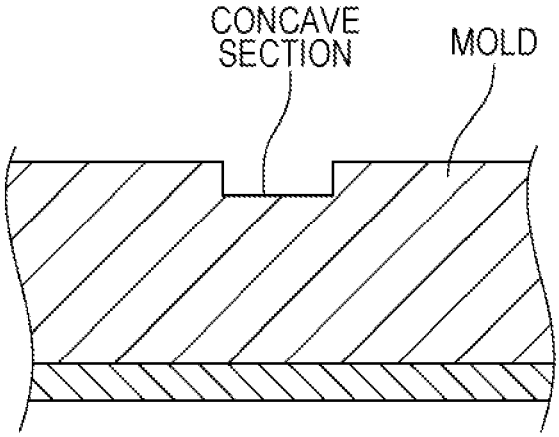
FIG. 6 is a cross-sectional view of a main part of a mold.
Figure 7:
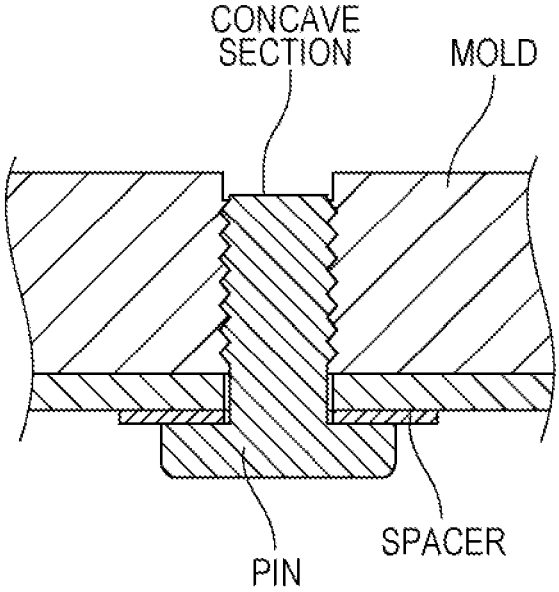
FIG. 7 is a cross-sectional view of the main part of the mold.

FIG. 5 is a schematic perspective view showing a bottom side of the lower case member 12. FIGS. 6 and 7 are cross-sectional views of a main part of a mold that forms the lower case member 12.

The wall-shaped enclosure 12*c* is formed to be thick as described above. The lower case member 12 itself is an article integrally molded by a resin and, in many cases, a thick part thereof cannot maintain the accuracy as designed due to an effect of contraction during cooling of the resin. This does not mean the presence of individual irregularities but the generation of a larger scale shift in the entire wall-shaped molded enclosure 12*c*. Even when the top of the wall-shaped enclosure 12*c* is intended to form a plane in design, the entire molded article may vary from being planar, even if only slightly, due to shrinkage of the resin and the contraction of the resin during the molding. As stated above, finishing to form a plane across the entire top of the wall-shaped enclosure 12*c* is not easy.

In this embodiment, a plurality of projections 12*c*1 are formed apart from each other in the top portion of the wall-shaped enclosure 12*c*. Specifically, the projections 12*c*1 are formed in eight places in total including four corners of the wall-shaped enclosure 12*c* with a substantially rectangular cross section and four places in the middle of each side. As a result, the top of each side of the wall-shaped enclosure 12*c* is a position where the projection 12*c*1 projects the most. The respective projections 12*c*1 do not have a uniform height from the top portion of the wall-shaped enclosure 12*c*. First, the lower case member 12 that has no projections 12*c*1 is molded. Then, the position of the top of the wall-shaped enclosure 12*c* is measured. Then, it is determined how much to raise the top of the wall-shaped enclosure 12*c* while assuming a plane that is parallel with the plane formed by the head chip 30 when the manifold member 28 (which holds the head chip 30) is set in the lower case member 12. When the height of each raising is determined for the eight positions described above, concave portions corresponding to the respective heights are formed on a mold side as shown in FIG. 6. Forming the concave portions on the mold side in this manner is easier than raising the inner portion. Also, finishing accuracy can be selected adequately.

Accordingly, the plane (that is formed by the top of the projection 12*c*1 of the wall-shaped enclosure 12*c*) can satisfy an intention of a designer by forming the concave portions of the mold with required accuracy and using this mold. When the lower case member 12 is put upside down in this state and the cover member 29 is mounted from above the wall-shaped enclosure 12*c* in a state where the head chip 30 is set, the cover member 29 abuts against the top of the projection 12*c*1 and is maintained in a plane without being affected by the non-planar shift inevitably generated in the wall-shaped enclosure 12*c* as described above. In a case where a plurality of the head chips 30 are set in the cover member 29, each of the head chips 30 can be arranged with high positional accuracy below the lower case member 12 since the plane is maintained. In this case, the cover member 29 does not necessarily have to be in contact with the projection 12*c*1 in a strict sense. Rather it is allowable for the cover 29 to abut against many of the projections 12*c*1 although perhaps being out of contact with a small number of the projections 12*c*1, so long as the expected plane is maintained. Also, since the cover member 29 itself is initially attached to and set in the lower case member 12 by using the adhesive applied to the top of the wall-shaped enclosure 12*c*, the adhesive may be interposed between the projection 12*c*1 and the cover member 29 so that the projection 12*c*1 and the cover member 29 are not in contact with each other in a strict sense.

In a case where the projection 12*c*1 is disposed on a cover member 29 side, and not on a wall-shaped enclosure 12*c* side, there is a concern that distortion may occur in the cover member 29 during a process in which the projection 12*c*1 is formed in the cover member 29 to deteriorate the planarity property. As such, the projection 12*c*1 may be disposed on the wall-shaped enclosure 12*c* side.

When the concave portion is formed by using a drill as shown in FIG. 6 during the formation of the projection 12*c*1, the top of the projection 12*c*1 is molded into a conical shape in many cases. In this case, abutting against the cover member 29 is made in a state of being close to a point. Alternatively, FIG. 7 shows an example in which the concave portion is formed by using a so-called pin. The pin, in general, has a configuration in which a male screw is screwed into a female screw hole. When the male screw is screwed deeply with a female screw, the concave portion becomes shallow inside the mold and the projection 12*c*1 is formed to be short. In contrast, when the male screw is screwed shallowly into the female screw, the concave portion becomes deep inside the mold and the projection 12*c*1 is formed to be long. If a spacer having a constant thickness is prepared in advance so as to determine the length, the length of each of the projections 12*c*1 can be freely adjusted.

The minimum required number of the projections 12*c*1 is three if the plane is to be identified. However, one thereof can be provided by a part of the wall-shaped enclosure 12*c*. Also, irregularities in the amount of the applied adhesive can be reduced as well through precise calibration of the rising in the projection 12*c*1. Also, it is preferable that the number of the projections 12*c*1 exceed three so as to prevent the cover member 29 from being bent due to a wide gap between the projections 12*c*1. Considering that the cover member 29 has a substantially square shape, formation at the eight places including the four corners of the wall-shaped enclosure 12*c* and the middle points thereof provides stability.

Figure 8:
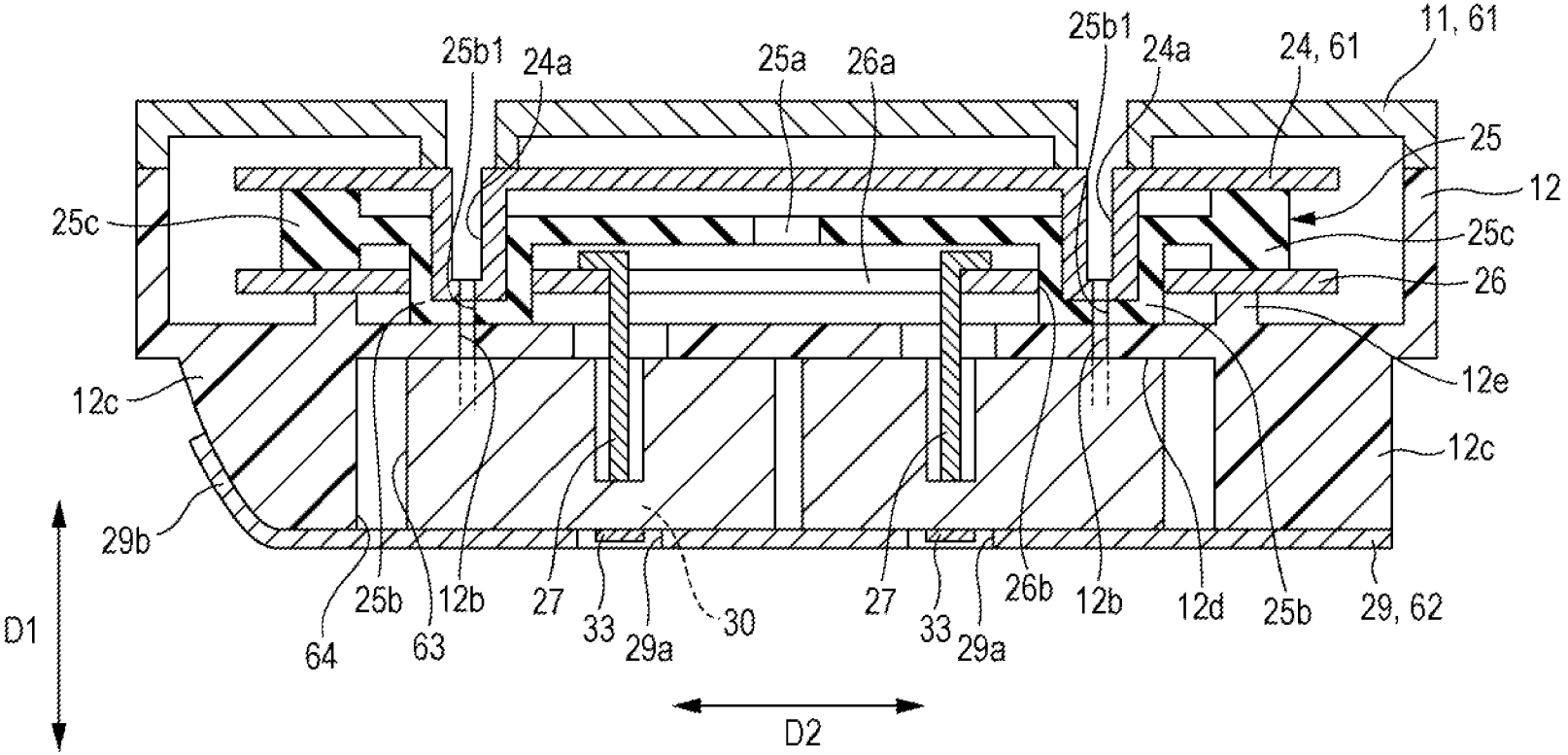
FIG. 8 is a schematic cross-sectional view showing an overall internal configuration of the case member.
Figure 9:
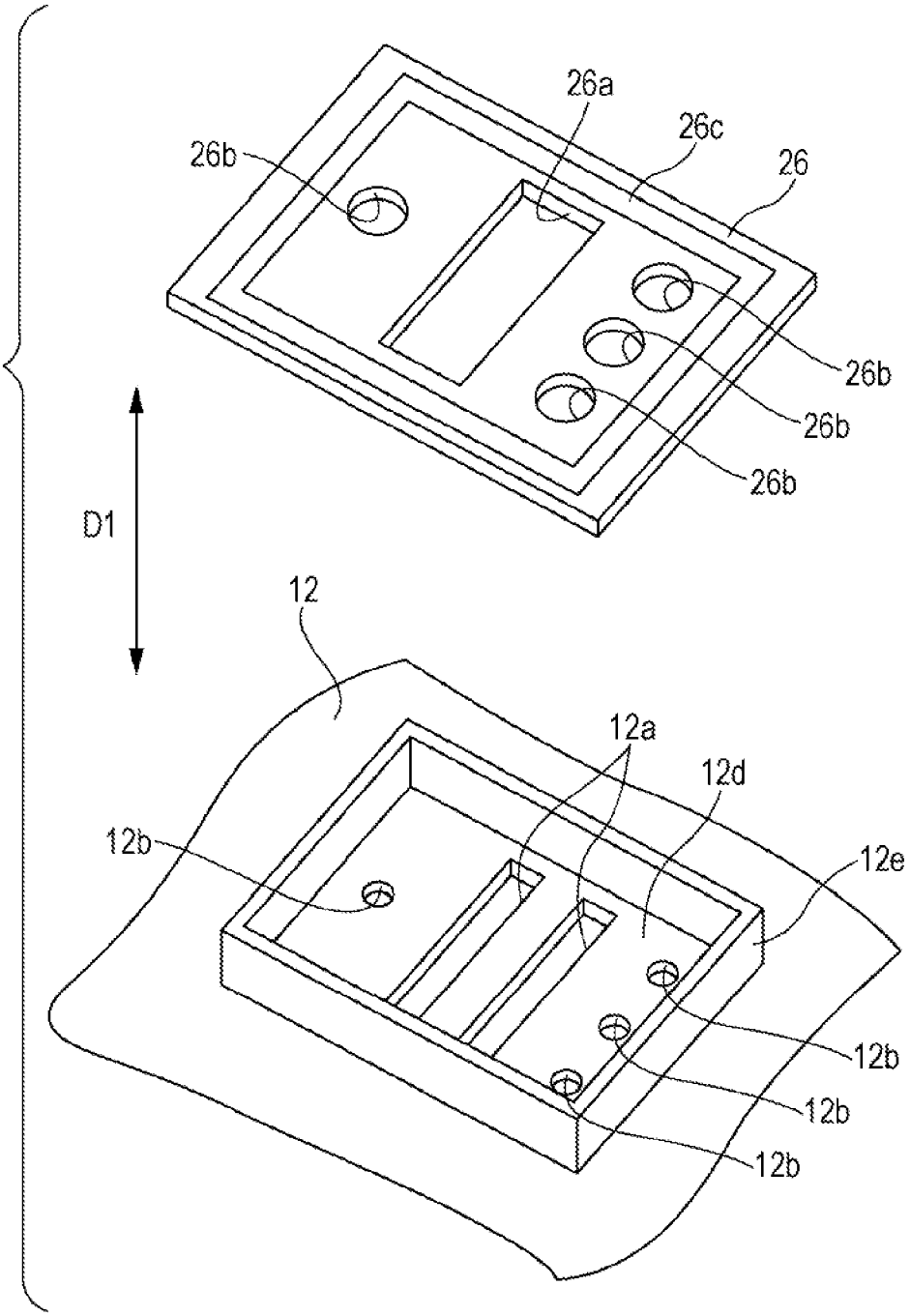
FIG. 9 is a schematic perspective view showing the overall internal configuration of the case member.
Figure 15:
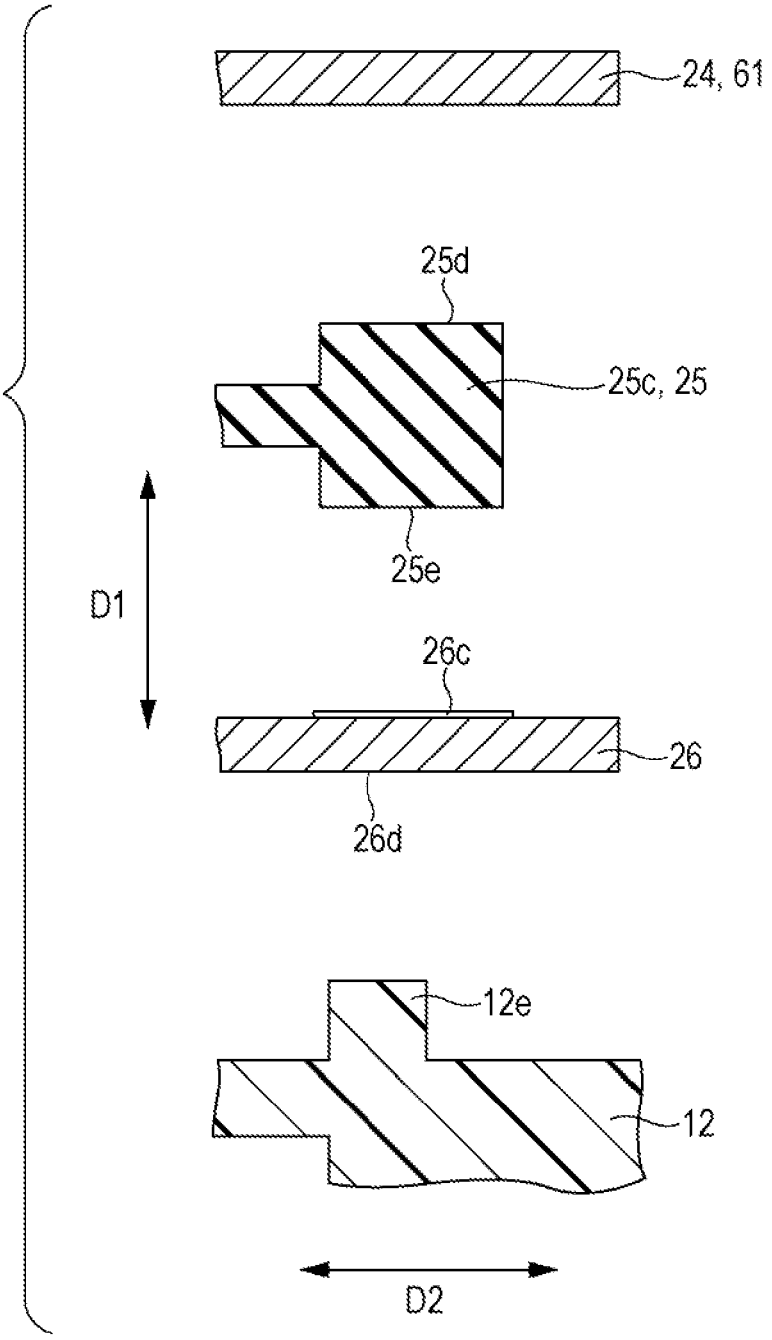
FIG. 15 is a schematic exploded cross-sectional view showing a continuous seal part and the vicinity thereof.

Next, a seal structure by the seal member 25 that is pinched between the lower case member 12 and the flow path portion 61 will be described. FIG. 8 is a schematic cross-sectional view showing an overall internal configuration of the case member. FIG. 9 is a schematic perspective view showing the overall internal configuration of the case member. FIG. 15 is a schematic exploded cross-sectional view showing a seal part 25*c* and the vicinity thereof.

The lower case member 12 is a case member that has the case member communication path (second communication path) 12*b* which communicates with the first communication path 24*a* of the flow path portion 61. The lower case member 12 forms a predetermined accommodating space on a side above a bottom wall 12*d* where the through-hole 12*a* and the case member communication path 12*b* are formed when combined with the upper case member 11. An inner rib (receiving portion) 12*e* that has a rectangular cross section is formed in a projecting manner upward from the bottom wall 12*d*. The through-hole 12*a* and the case member communication path 12*b* are formed on a further inner side of the bottom wall 12*d* than the inner rib 12*e*. The circuit substrate 26 is mounted on a top of the inner rib 12*e*, and the seal member 25 and the flow path member 24 are mounted thereon. The top of the inner rib 12*e* identifies a plane that can be in close contact with the circuit substrate 26. The top, in this sense, forms a planar section and the circuit substrate is mounted on the planar section.

The circuit substrate 26 is connected to the flexible substrate 27 and is electrically connected with the head chip 30. The circuit substrate 26 shown in FIGS. 1 and 8 has an external shape that is larger than the inner rib 12*e*, and the top of the inner rib 12*e* abuts continuously against a lower surface of the circuit substrate 26 in a state where the circuit substrate 26 is mounted on the inner rib 12*e*. The part where the top of the inner rib 12*e* and the circuit substrate 26 abut against each other is hermetically fixed by applying in advance a predetermined amount of a hermetic adhesive to the top of the inner rib 12*e* prior to abutting against each other. The inner rib 12*e* itself is a three-dimensional cylindrical object and the planar circuit substrate 26 is attached to and set in the planar section formed in the opening thereof so that rigidity of the entire lower case member 12 can be increased around the inner rib 12*e*. The circuit substrate 26 is a print substrate, and multiple leads which are electrically connected to the flexible substrate 27 are formed in an edge portion of a through port 26*a*. Also, a lead terminal (not shown) is formed in an outer edge portion as well, and is electrically connected to the outside via a connector. In this manner, the head 1 represents a structure in which electrical wiring is withdrawn from the outside. For instance, the flexible substrate 27 is connected to the circuit substrate 26 in the sealed space. Further, the circuit substrate 26 extends to the outside beyond a seal surface 25*e* (contact part 26*c*) that is a position of the sealing by seal part 25*c*. The patterned electrical wiring (circuit) is withdrawn from outside the seal surface 25*e*, and the connector is disposed in the withdrawn part of the electrical wiring. In this manner, the head 1 realizes the sealing for suppressing the moisture evaporation from the ink and the withdrawal of the electrical wiring from the ambient environment.

Through ports 26*b* are formed at a position on the circuit substrate 26 which corresponds to the respective case member communication paths 12*b* of the lower case member 12. In this case, the through ports 26*b* are formed at the position that corresponds to the case member communication paths 12*b* and the case member communication paths 12*b* are in a state of being exposed in an up-down direction. The case member communication path 12*b* communicates with the communication path 28*b* of the manifold member 28 through a passage (not shown) as described above.

The seal member 25 (which is formed from an elastic material containing a rubber material, for example an elastomer) has an external shape which is smaller than the external shape of the circuit substrate 26, but has an external shape which is larger than an area including the through port 26*a* and the through port 26*b*, and has a small through port 25*a* which is approximately 4 mm in diameter, formed in the center thereof. Also, a convex part 25*b* (that projects downward and is formed into a cup shape) is formed at a position corresponding to each of the through ports 26*b* of the circuit substrate 26. The convex part 25*b* is fitted into an inner circumferential surface of the through port 26*b* on an outer circumferential surface of a cup-shaped cylindrical part to fulfill a positioning function when inserted into the through port 26*b* of the circuit substrate 26. A cup-shaped bottom surface abuts against a circumferential edge portion of the opening of the case member communication path 12*b*. A through port 25*b*1 is also formed in the bottom surface to form a communication passage communicating with the case member communication path 12*b*.

The head 1 has a function of a joint linking the communication paths 24*a* and 12*b* with each other. The head 1 also seals the entire case with the single member of the seal member 25, and thus is excellent in ease of assembly.

The elastic seal member 25 has the seal part 25*c* which is pinched by the circuit substrate 26 and the flow path portion 61. A continuous seal part 25*c* (whose thickness continuously increases upward and downward) is formed on a circumferential edge of the seal member 25 that is shown in FIGS. 1, 8, and 15. A lower surface of the continuous seal part 25*c* is in contact with an upper surface (contact part 26*c*) of the circuit substrate 26 and an upper surface 25*d* thereof is in contact with a lower surface of the flow path portion 61 when the flow path member 24 is mounted on the seal member 25. The upper surface 25*d* of the seal part 25*c* may be in contact with the flow path member 24 and may be in contact with the upper case member 11. In a case where the upper surface 25*d* of the seal part is in contact with the lower surface of the flow path member 24, the space on a flow path portion 61 side that is sealed by the seal member 25 is the space between the seal member 25 and the flow path member 24. In a case where the upper surface 25*d* of the seal part is in contact with the lower surface of the upper case member 11, the space on the flow path portion 61 side that is sealed by the seal member 25 is the space between the seal member 25 and the upper case member 11.

As shown in FIG. 15, the seal part 25*c* on the flow path portion 61 side in the seal member 25 extends toward the flow path portion 61 side. Also, the upper surface 25*d* is formed into a planar shape which has the path open to the atmosphere as a narrow groove. The seal part 25*c* on a circuit substrate 26 side in the seal member 25 is the seal surface 25*e* for the contact part 26*c* of the circuit substrate 26. The seal surface 25*e* shown in FIG. 15 has a planar cross-sectional shape. The seal surface 25*e* that is in contact with the contact part 26*c* of the circuit substrate 26 shown in FIG. 9 surrounds the through ports 26*a* and 26*b* of the circuit substrate 26. Since the planar seal surface 25*e* is formed in the seal part 25*c*, the close contact between the seal part 25*c* and the circuit substrate 26 is improved and the sealing of the predetermined space 63 is improved from the seal member 25 toward a lower case member 12 side.

Silk printing is performed on the contact part 26*c* of the circuit substrate 26 in contact with the seal part 25*c* and in contact with the seal surface 25*e* to smoothen the unevenness of the surface of the circuit substrate 26. The unevenness is present on the circuit substrate surface for patterning or the like of the circuit substrate. As a result of an actual measurement, the unevenness of the circuit substrate surface where the silk printing was not performed was approximately up to 30 μm, and the unevenness of the surface of the circuit substrate where the silk printing was performed was approximately one half of the unevenness of the circuit substrate surface where the silk printing was not performed. When the silk printing is performed on the contact part 26*c* in this manner and the planar seal surface 25*e* is in contact with the contact part 26*c*, excellent close contact is obtained between the seal part 25*c* and the circuit substrate 26. Furthermore, the sealing of the predetermined space 63 is improved from the seal member 25 toward a lower case member 12 side.

A contact part 26*d* that is the rear side of the circuit substrate 26 which is opposite to the contact part 26*c* is in close contact with the inner rib 12*e* of the lower case member 12.

The inner rib 12*e* is a receiving portion that pinches the circuit substrate 26 with the seal part 25*c* of the seal member 25. Since the receiving portion (inner rib 12*e*) is present immediately beneath the seal surface (contact part 26*c*) of the circuit substrate 26, bending of the circuit substrate 26 is suppressed when the seal surface (26*c*) of the circuit substrate 26 is sealed by the seal part 25*c*.

A cylindrical communication path 24*a* that corresponds to the convex part 25*b* of the seal member 25 and projects downward is formed in the flow path member 24. The length thereof is equivalent to the length of a lower end of the communication path 24*a* in contact with the bottom surface in the convex part 25*b* when the flow path member 24 is mounted on the seal member 25 and is in contact with the continuous seal part 25*c*. The flow path member 24 is accommodated in such a manner as to be pressed downward in the lower case member 12. In this case, the flow path member 24 abuts against the continuous seal part 25*c* in a circumferential edge part and the communication path 24*a* abuts against the bottom surface in the convex part 25*b*. Also, the continuous seal part 25*c* of the seal member 25 continuously abuts against the circumferential edge part of the circuit substrate 26 on a lower surface thereof and a lower surface side of the bottom surface of the convex part 25*b* abuts against the circumferential edge portion of the opening of the case member communication path 12*b*. When a predetermined pressing force is added from the flow path member 24, the seal member 25 achieves a sealing function in the abutting part in the above-described manner.

As described above, the elastic seal member 25 has a plate shape and is bordered by the wall-shaped seal part 25*c*, and thus is unlikely to be deformed and is likely to maintain the shape. As such, the seal member 25 is easily held and provides excellent handling when assembled. Also, the seal member 25 has the cylindrical convex part 25*b* toward the case member 12 side and the circuit substrate 26 has the through port 26*b* penetrated by the convex part 25*b*. Thus a position of the seal member 25 in a lateral direction D2 which is orthogonal to a stacking direction D1 is determined during the assembly. Since the convex part 25*b* is present in the planar seal member 25, the seal member 25 is unlikely to be kink and the assembly position can be matched so that the assembly of the seal member 25 is facilitated.

Also, the sealing is not easy with a structure in which one communication path is inserted into the other communication path when the first communication path 24*a* is linked with the second communication path 12*b*. In the seal structure of the head 1, the seal member 25 is put between the communication paths 24*a* and 12*b* of the seal member 25 in the stacking direction D1, and the sealing is realized through a simple operation in which the seal member 25 allows easy holding and easy positioning is stacked along with the circuit substrate 26, the flow path member 24, and the like and pressed in the stacking direction D1.

Also, at the position of the inner rib (receiving surface) 12*e* of the lower case member 12 that receives the circuit substrate 26, the flow path portion 61 and the lower case member 12 pinch the seal part 25*c* and the upper case member 11 and the lower case member 12 included in the flow path portion 61 are set with each other outside the inner rib 12*e*. When the upper case member 11 is pressed toward the lower case member 12 side during the assembly of the head 1, the seal member 25 is pressed toward the lower case member 12 side. It is not preferable to add stress toward the lower case member 12 side to an electrical circuit such as the piezoelectric actuator between the seal member 25 and the lower case member 12 side, but the stress toward the lower case member 12 side is unlikely to be added to the electrical circuit such as the piezoelectric actuator because of the structures of the wall-shaped enclosure 12*c* which forms the space 63 where the head chip 30 is arranged and the bottom wall 12*d* and the upper case member 11 and the lower case member 12 are set on a further outer side than the space 63. As such, the sealing in the up-down direction (stacking direction D1) is possible with an easier assembly than in the structure in which one of the communication paths 24*a* and 12*b* is inserted into the other communication path, and a very excellent assembly of the head is realized along with the excellent assembly of the seal member 25 itself described above.

As described above, the first communication path 24*a* of the flow path member 24 corresponds to a first communication path, the case member communication path 12*b* corresponds to a second communication path, and the communication path 28*b* of the manifold member 28 corresponds to a third communication path. In FIG. 8, the communication path 28*b* is not shown for simplicity. The opening 64 in which the predetermined space 63 is formed inside by the wall-shaped enclosure 12*c* is formed on a printing medium side of the lower case member 12. The cover member 62 covers the opening 64 in a state where the head chip 30 is arranged in the predetermined space 63 and the nozzle 33*a* is exposed to the outside. The seal member 25 allows the first communication path 24*a* and the second communication path 12*b* to be connected with each other in a liquid-tight state (state where a liquid does not leak), and seals the predetermined space 63 on the case member 12 side. The manifold member 28 shown in FIG. 3, which is in a state where the head chip 30 is held, is set in the lower case member 12 in the predetermined space 63, and the opening 64 is blocked by the cover member 29 in a state where the nozzle surface of the head chip 30 is exposed to the outside. Further, the seal member 25 (which causes the first communication path and the second communication path to be connected with each other in a liquid-tight manner), is interposed between the flow path member 24 and the lower case member 12 via the circuit substrate 26 in the stacking direction D1 of the flow path member 24. The sealing member thus seals an opening-side space in the lower case member 12. In other words, a liquid-tight structure can be easily formed in a predetermined part just through stacking with the seal member 25 being interposed. Compared to a case where the seal member is formed by separate bodies, the formation of the integrated seal member is likely to result in a reduction of the size of the entire seal member and an improvement in assemblibility because the number of components is reduced.

In this case, since the small through port 25*a* is formed in the seal member 25, the space 63 on a lower side of the seal member 25 and the space between the seal member 25 and the flow path portion are sealed in a communicating state. Also, the narrow-grooved path open to the atmosphere is formed on the upper surface 25*d* of the continuous seal part 25*c*. This allows the space on an inner circumferential side and the atmosphere on an outer circumferential side to communicate with each other on the upper surface 25*d* of the continuous seal part 25*c*. In other words, the path open to the atmosphere is formed into a groove-shaped part that is formed in a close contact surface in the stacking direction D1.

A large amount of gas does not move in and out because the groove shape is significantly narrow. Rather, a very small amount of gas moves in and out. In the invention, a sealed state is obtained where the movement of this amount of gas is allowed. This is used so that the very small pressure change generated during a displacement of the above-described compliance member 40 is transmitted to the outside for opening.

The above-described seal member 25 is a member that divides the case member 12 side space 63 from the flow path portion 61 side space in the head 1 and seals the respective spaces. Despite the sealing, it is preferable to communicate slightly with the atmosphere (so-called opening to the air) so as to suppress the pressure change in the space. As described above, the path open to the atmosphere is disposed in the flow path portion 61 side space. The lower case member 12 side space 63, being a space on the side where the ink is discharged, may be subjected to an effect from the ink and mist when the lateral direction D2 crossing the stacking direction D1 of the seal member 25 and the cover member 62 side are open to the air. Since the small through port 25*a* is disposed in the seal member 25, the effect from the ink and mist can be suppressed and the case member 12 side space 63 can be open to the air via the path open to the atmosphere of the seal part upper surface 25*d*.

In this embodiment, the flow path member 24 is covered by the upper case member 11, and the ink cartridges 221 and 222 (refer to FIG. 16) that are holding members for the liquid are mounted and set on the upper case member 11. The passage reaching the flow path member 24 from the ink cartridge via the upper case member 11 also has to be a liquid-tight communication path. For instance, in this embodiment, a liquid-tight structure using an O-ring (not shown) or the like is formed. Also, the upper case member 11 is screwed to and set in (for example, screwing) the lower case member 12 from a lower side of the case. Furthermore, a pressing force is generated downward in the above-described stacking direction D1 by the flow path member 24 when the upper case member 11 approaches the lower case member 12 to be fastened.

Even when the seal member 25 is pinched and fastened by screwing between the upper case member 11 and the lower case member 12 in this manner, the planar substrate that is attached to and set in the above-described wall-shaped enclosure 12*c*, the bottom wall 12*d* and, further, the inner rib 12*e* effectively suppresses the bending generated in the lower case member 12. During the assembly of the seal member 25 between the upper case member 11 and the lower case member 12, a cumbersome operation in which an adhesive is used is not necessary. Rather, simple compression pinching allows the assembly with simplicity.

The communication paths for the ink that reaches the head chip 30 from the ink cartridges 221 and 222 are the communication path 24*a* (first communication path) of the flow path member 24, the case member communication path 12*b* (second communication path), and the communication path 28*b* (third communication path) of the manifold member 28 as described above. Since the ink is supplied to the head chip 30 through the flow path in each of the members accommodated in the internal space 63 formed by the upper case member 11 and the lower case member 12, the ink is not easily dried. However, in the part that is set by using the adhesive, consideration for easy drying is required depending on gas barrier properties of the adhesive. In a case where the head chip 30 is smaller in size than in the related art, an effect of thickening of the ink by drying becomes significant because the absolute amount of the ink held inside is small. In this embodiment, a silicon-based adhesive or a modified epoxy-based adhesive is used considering the flexibility. Properties of the modified epoxy-based adhesive are different from those of an epoxy-based adhesive with hardness and low water permeability, and are close to properties of a silicon-based adhesive, and have a merit of being capable of stress relief because of the flexibility. When the adhesive having flexibility is used to fix the members with each other, the peeling of the members is unlikely to be generated. The modified epoxy-based adhesive has a disadvantage of relatively high water permeability as well. The modified epoxy resin has high flexibility but low gas barrier properties, and thus the moisture contained in the ink is permeated outside to cause the thickening of the ink. However, as described above, the head chip 30 or the like is held in the space 63 that is sealed by the seal member 25 and the sealed space 63 is filled with the permeated moisture so that more permeation is unlikely to occur and the structure becomes resistant to the thickening. Also, the flow path formed from the first communication path and the second communication path described above is identified inside the case member surrounded by the upper case member 11 and the lower case member 12. Accordingly, a flow path is formed for the liquid from an upstream side corresponding to the ink cartridges 221 and 222 toward a downstream side corresponding to the third communication path.

In the above-described example, the two head chips 30 are arranged in the one space 63, but one head chip may be arranged or three or more head chips may be arranged in the one space 63. Also, the case member 12 may have a plurality of the spaces 63 instead of the one space 63. The head chip of the above embodiment is a concept including the piezoelectric actuator part 31, the flow path forming plate 32, the nozzle plate 33, and the compliance member 40, alternatively the head chip 30 may be a concept including a manifold member 28 too in addition to those. In other words, the head chip 30 of the present invention may be any channel unit that is disposed in a predetermined space, evaporation of the liquid may occur from the joining portion of the members to each other. And furthermore, configuration of the head chip 30 of the present invention can also be said that a combination of electromechanical conversion mechanism for converting electrical energy to mechanical energy and flow path member. Further, the cover member 62 and the head chip are separate members in the above embodiment, alternatively those may be any member integrated with the cover member 62 and the head chip 30 as a unitary member.

Figure 16:
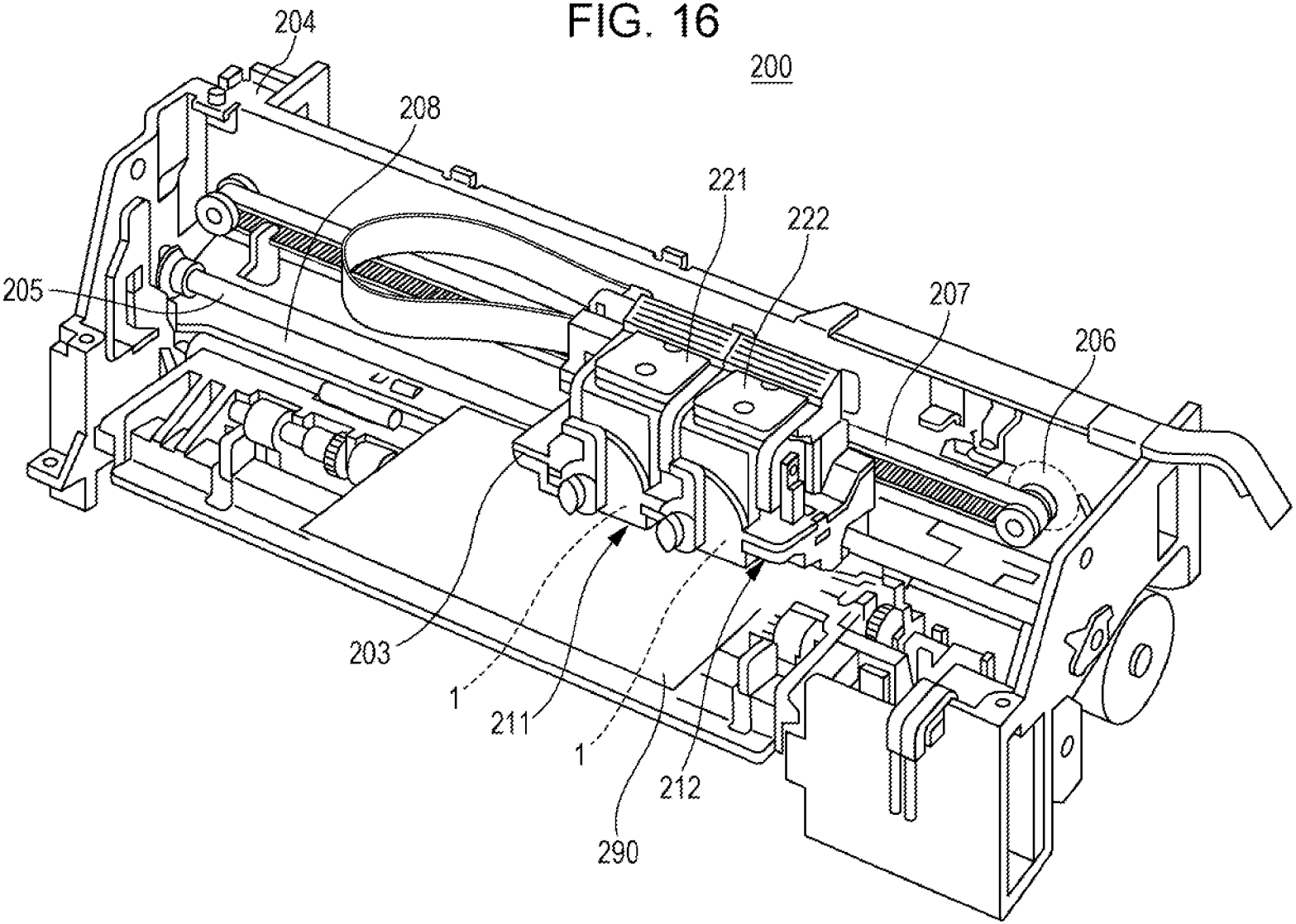
FIG. 16 is a schematic perspective view showing a configuration of a recording apparatus.

An example of a liquid ejecting apparatus on which the above-described liquid ejecting head is mounted will be described with reference to FIG. 16. FIG. 16 is a view showing an external appearance of an ink jet type recording apparatus (liquid ejecting apparatus) 200 that includes the above-described head 1. The recording apparatus 200 can be manufactured by incorporating the head 1 into recording head units 211 and 212. In the recording apparatus 200 shown in FIG. 16, the head 1 is disposed in each of the recording head units 211 and 212, and the ink cartridges (liquid holding units) 221 and 222 that are external ink supply units are disposed in a removable manner. A carriage 203 (on which the recording head units 211 and 212 are mounted) is disposed in a reciprocally movable manner along a carriage shaft 205 mounted on an apparatus main body 204. When a driving force of a driving motor 206 is transmitted to the carriage 203 via a plurality of gears (not shown) and a timing belt 207, the carriage 203 moves along the carriage shaft 205. A recording sheet 290 that is fed by a paper feed roller (not shown) or the like is transported onto a platen 208, and printing is performed by ink (liquid) supplied from the ink cartridges 221 and 222 and discharged from the head 1.

In a case where the printing is performed, it is preferable to clean the nozzle surface at a certain frequency. Cleaning by wiping contamination on the surface is performed with a wiper formed from an elastic material.

Figure 10:
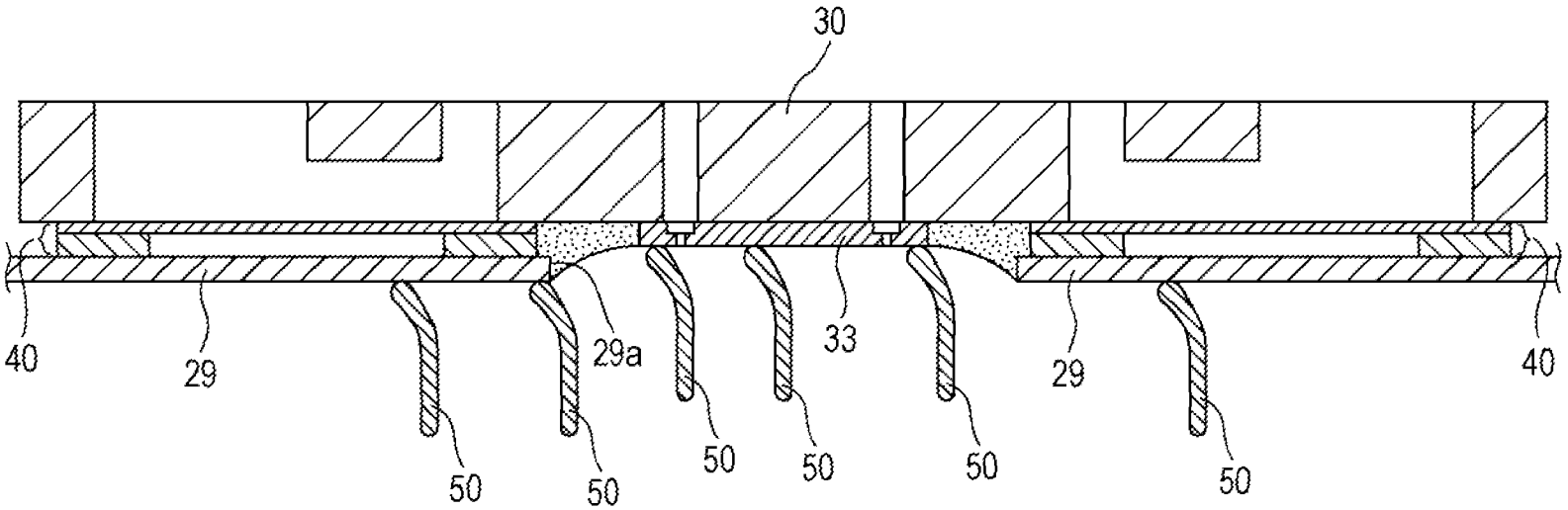
FIG. 10 is a schematic cross-sectional view showing a wipe process.

FIG. 10 is a schematic cross-sectional view showing the wipe process.

As described above, the nozzle plate 33 is held in the opening 29*a* of the cover member 29 at a position further recessed than the surface of the cover member 29.

A wiper 50 is set at a position shifted from a printing area within a range of main scanning of the liquid ejecting head, and a top of the wiper 50 wipes the cover member 29 and the surface of the nozzle plate 33 as the liquid ejecting head is relatively moved with respect to the wiper 50 and a wiping part of the wiper 50 wipes the ink remaining on both of the surfaces. This operation is referred to as wiping. As shown in FIG. 10, a top-sided part of the wiper 50 is moved to slide upward as a first step when moving from the almost flat surface of the cover member 29 to the surface of the nozzle plate 33 in the opening 29*a*. Further, the top-sided part of the wiper 50 is moved to slide downward as a second step when finishing the surface of the nozzle plate 33 and moving back to the surface of the cover member 29. When the step parts are not smoothly continuous, the ink or the like that is collected on the top of the wiper 50 is captured in a non-continuous part, and the liquid ejecting head may not be clean.

In this embodiment, the step generated between the nozzle plate 33 and the cover member 29 is filled with a filling material so that the surfaces are smoothly connected with each other.

Figure 11:
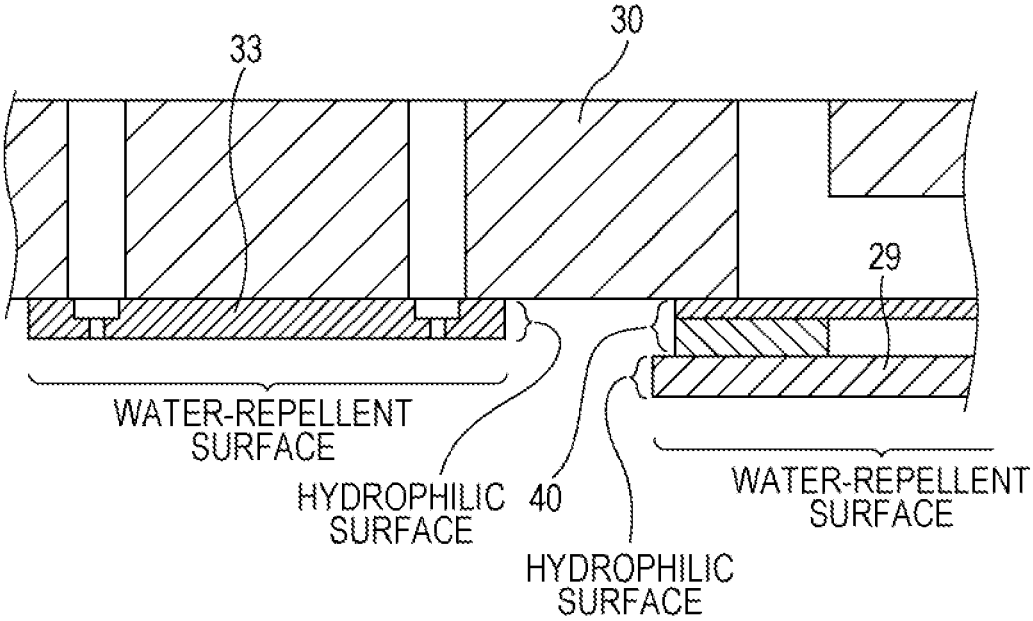
FIG. 11 is a schematic cross-sectional view showing a nozzle plate and a cover member.
Figure 12:
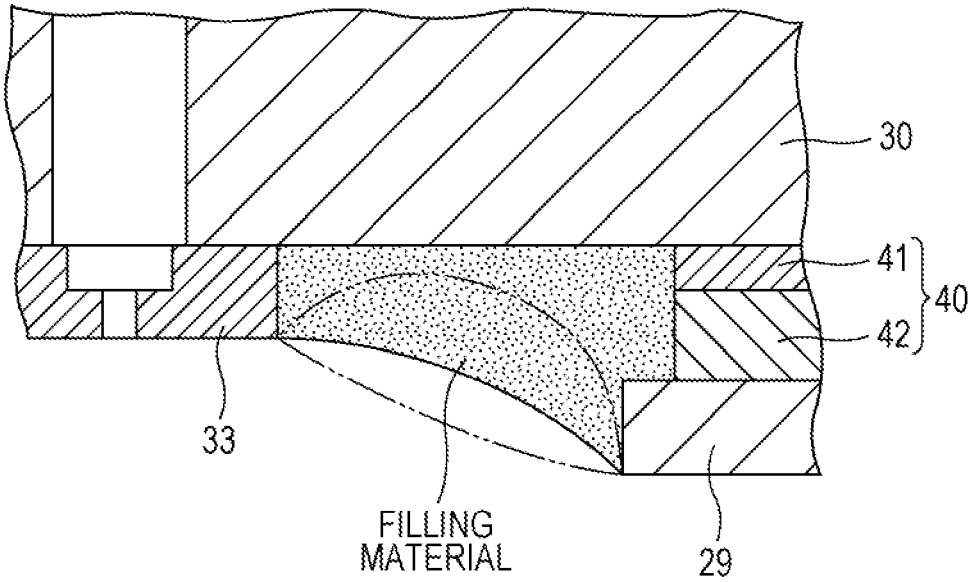
FIG. 12 is a schematic cross-sectional view showing a state where the amount of a filling material differs.

FIG. 11 is a schematic cross-sectional view showing the nozzle plate and the cover member. FIG. 12 is a schematic cross-sectional view showing a state where the amount of the filling material differs.

The space filled with the filling material is a part surrounded by a side surface of the nozzle plate 33, a lower surface of the head chip 30, a side surface of the compliance member 40, and an extremely small part of a lower surface and the side surface of the cover member 29. When the amount of the filling material is large, overflowing is caused and a filling agent may capture the ink. Meanwhile, when the amount of the filling material is small, permeation is not made in a part where the permeation is required and the concave portion is formed so that the concave portion may capture the ink. Also, when the amount of the filling material is small, the side surface of the nozzle plate 33 is in an exposed state. Since the nozzle plate 33 is formed of silicon as described above and is vulnerable to static electricity, there is a concern that the nozzle plate 33 is electrostatically broken down. Accordingly, the filling material is filled by an amount less than a predetermined amount and, as shown in FIG. 11, both or at least one of the surfaces and the side surfaces is subjected to a coating treatment so that the surfaces of the lower surfaces of the nozzle plate 33 and the cover member 29 become water-repellent surfaces and the surfaces of the side surfaces of the nozzle plate 33 and the cover member 29 become relatively hydrophilic surfaces with respect to the surfaces of the lower surfaces. Then, when the small amount of the filling material begins to fill the space, the filling material is spread on the hydrophilic surfaces of the side surfaces of the nozzle plate 33 and the cover member 29. Accordingly, when the amount of filling material is not sufficient, the filling material still creeps up the side surfaces in such a manner as to cover the entire side surfaces. The spreading is made in the so-called principle of surface tension. The spreading is initiated from when the amount of the filling material is small.

In FIG. 12, the solid line shows the optimum designed amount of the filling material. However, even in a case shown with the dashed line where the amount of the filling material is small, the filling material spreads up the hydrophilic surfaces of the side surfaces of the nozzle plate 33 and the cover member 29. Accordingly, a gap or the like caused by insufficient filling material does not occur along at least the side surfaces of the nozzle plate 33 and the cover member 29. Also, the specified amount is to the extent of being slightly recessed than the straight line linking edge portions of the surfaces of the nozzle plate 33 and the cover member 29 with each other. This state is a state where an exposed part of the filling material forms a slightly recessed surface. Even when the filling is made to exceed a necessary mount in a rare case, the surfaces of the nozzle plate 33 and the cover member 29 are treated to be water-repellent and thus the filling material does not spread along these surfaces.

Also, epoxy and an adhesive can be applied as the filling material, but examples thereof are not limited thereto.

In other words, when the lower surface of the liquid ejecting head is formed by the nozzle plate 33 and the cover member 29, the surface of the nozzle plate 33 and the surface of the cover member 29 are the water-repellent surfaces. Furthermore, the side surfaces of the nozzle plate 33 and the cover member 29 are relatively hydrophilic surfaces compared to the surfaces and the gap between the nozzle plate 33. Also, the cover member 29 is filled with the filling material. If at least the side surface of the nozzle plate 33 is covered by the filling material, the nozzle plate 33 can be protected from static electricity. Further, if the side surface of the cover member 29 is covered by the filling material, wiping by the wiper 50 is improved.

Figure 13:
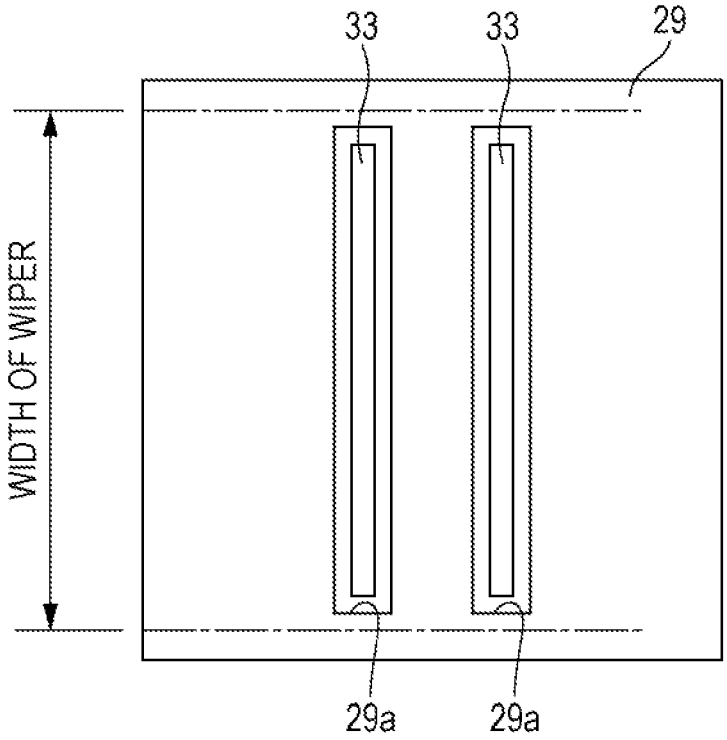
FIG. 13 is a schematic bottom view showing a state where the cover member is viewed from below.
Figure 14:
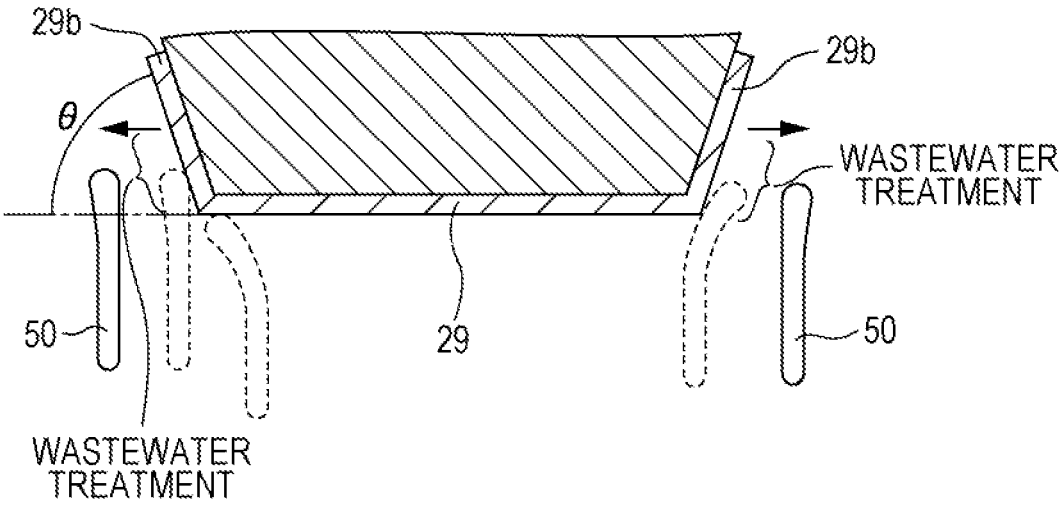
FIG. 14 is a schematic side view showing a state where the cover member and a wiper abut against each other.

FIG. 13 is a schematic bottom view showing a state where the cover member is viewed from below. FIG. 14 is a schematic side view showing a state where the cover member and the wiper abut against each other.

The nozzle plate 33 has a strip-like long shape, and the above-described gap is generated along each of the two sides of the long side and the short side. The nozzle 33*a* is formed along the long side direction and the liquid ejecting head has a direction orthogonal to the long side. The wiper 50 is moved in a direction orthogonal to the relative long side, and the ink is likely to enter the gap on the long side. In this sense, it is effective to render the step of the surface smooth by using the above-described filling agent in a direction crossing the direction in which the liquid ejecting head is moved.

In order for the wiper 50 to effectively wipe the surfaces of the cover member 29 and the nozzle plate 33, the wiper 50 itself has to have elasticity and the distance between the wiper 50 and both thereof has to have a positional relationship to the extent of the wiper 50 being bent while abutting. The liquid ejecting head is driven when the wiper 50 has the length to the extent of being bent. Accordingly, an end section of the cover member 29 begins to abut against the wiper 50.

In this embodiment, an end section part of the cover member 29 is bent across a predetermined length toward the wiping direction, and an angle θ of the lower surface with respect to the plane is 45° to 80°. As shown in FIG. 14, when the liquid ejecting head is driven and the wiper 50 begins to abut relatively against the end section of the cover member 29, the top of the wiper 50 first abuts against a bent end section 29*b* of the cover member 29. Then, the top of the wiper 50 is gradually bent and wipes the lower surface of the cover member 29 and the surface of the nozzle plate 33 described above to wipe the contamination such as the ink. The wiped ink gradually remains on the surface of the wiper 50, and the ink that remains on the wiper 50 is likely to be attached to the vicinity of the bent end section 29*b* against which the wiper 50 abuts first. Accordingly, the water-repellent treatment is performed in advance in both the wiper 50 and in the vicinity of the bent end section 29*b* so that the ink is likely to come off naturally before being gradually attached to the wiper 50 or before the attached ink is moved to the bent end section 29*b* to be accumulated. Also, the water-repellent treatment may be performed across the entire surface of the cover member 29, but the above-described effect can be obtained if the water-repellent treatment is performed in the part where the wiper 50 first abuts against the bent end section 29*b* and the vicinity thereof. Also, the ink is likely to come off following the water-repellent treatment when the bent end section 29*b* has an angle of 45° to 80°. Also, although FIG. 14 is a schematic view, the bent end section 29*b* is disposed on both sides based on the direction in which the liquid ejecting head is driven. In this case, the wiping of the cover member 29 and the nozzle plate 33 can be performed effectively on the surface on the side opposite to the wiper 50 when the liquid ejecting head passes through the holding position of the wiper 50 and is reversed again.

Various modification examples of the invention can be considered.

For example, examples of the liquid that is discharged from the liquid ejecting head include a solution in which a dye or the like is dissolved by a solvent, and a fluid such as a solution in which a pigment or solid particles such as metallic particles are dispersed by a dispersion medium. Examples of such fluids include ink, liquid crystal, and the like. The liquid ejecting head can be mounted on apparatuses for manufacturing color filters such as liquid crystal displays, apparatuses for manufacturing electrodes such as organic EL displays, biochip manufacturing devices, and the like in addition to image recording apparatuses such as printers.

Also, the invention is not limited to the above-described embodiment, but the followings are appreciated by those skilled in the art as an embodiment of the invention.

The mutually replaceable members, configuration, and the like disclosed in the above-described embodiment can be applied through an appropriate change in combination thereof.

Although not disclosed in the above-described embodiment, the members, configuration, and the like disclosed in the above-described embodiment as the related art and the mutually replaceable members, configuration, and the like can be applied through an appropriate replacement or a change in combination thereof.

Although not disclosed in the above-described embodiment, the members, configuration, and the like that are disclosed in the above-described embodiment and can be assumed and replaced by those skilled in the art based on the related art can be applied through an appropriate replacement or a change in combination thereof.

The entire disclosure of Japanese Patent Application No.: 2013-067437, filed Mar. 27, 2013, Japanese Patent Application No.: 2013-162000, filed Aug. 5, 2013 and Japanese Patent Application No.: 2014-037976, filed Feb. 28, 2014 are expressly incorporated by reference herein.

What is claimed is:

1. A liquid ejecting head comprising:

a flow path portion that includes a first communication path which allows a liquid from a liquid holding unit to pass;

a case member that includes a second communication path which communicates with the first communication path;

a seal member that is pinched between the case member and the flow path portion; and a cover member to which a head chip that discharges the liquid from a nozzle communicating with the second communication path is set;

wherein an opening that has a predetermined space formed inside is formed on a recording medium side of the case member, wherein the cover member covers the opening in a state where the head chip is arranged in the predetermined space and the nozzle is exposed to an outside, and wherein the seal member allows the first communication path and the second communication path to be connected in a liquid-tight manner and seals the predetermined space on a case member side.

2. The liquid ejecting head according to claim 1, wherein the seal member seals the predetermined space on the case member side and seals a space between the flow path portion and the seal member.

3. The liquid ejecting head according to claim 1, wherein a seal part of the seal member has a groove-shaped path open to an atmosphere.

4. The liquid ejecting head according to claim 1, wherein the seal member is formed of an elastomer.

5. The liquid ejecting head according to claim 1, further comprising:

a flexible substrate that is connected to the head chip; and a circuit substrate that is connected to the flexible substrate, wherein the seal member has a seal part that is pinched by the circuit substrate and the flow path portion, and wherein the circuit substrate extends to a further outer side than a position of sealing by the seal part and a circuit that is connected to the flexible substrate is on a further outer side than the sealing position as a pattern.

6. The liquid ejecting head according to claim 5, further comprising a circuit substrate that is electrically connected with the head chip, wherein the seal member has a seal part that is pinched by the circuit substrate and the flow path portion, wherein the seal part of the seal member on a circuit substrate side has a planar shape, and wherein silk printing is performed on a part of the circuit substrate in contact with the seal part to smoothen unevenness of a circuit substrate surface.

7. The liquid ejecting head according to claim 5, wherein the case member has a receiving portion that pinches the circuit substrate with the seal part of the seal member.

8. The liquid ejecting head according to claim 1, wherein the seal member is formed into a plate shape laminated with the flow path portion, wherein the seal member hermetically seals the predetermined space on the case member side with a seal part on the case member side, wherein the seal member seals the space between the flow path portion and the seal member, wherein the seal member has a groove-shaped path open to an atmosphere in a seal part on a flow path portion side, and wherein the seal member allows the predetermined space on the case member side and the space between the flow path portion and the seal member to communicate with each other.

9. A liquid ejecting apparatus comprising a liquid ejecting head, the liquid ejecting head comprising:

a flow path portion that includes a first communication path which allows a liquid from a liquid holding unit to pass;

a case member that includes a second communication path which communicates with the first communication path;

a seal member that is pinched between the case member and the flow path portion; and a cover member to which a head chip that discharges the liquid from a nozzle communicating with the second communication path is set;

wherein an opening that has a predetermined space formed inside is formed on a recording medium side of the case member, wherein the cover member covers the opening in a state where the head chip is arranged in the predetermined space and the nozzle is exposed to an outside, and wherein the seal member allows the first communication path and the second communication path to be connected in a liquid-tight manner and seals the predetermined space on a case member side.

10. A liquid ejecting apparatus in accordance with claim 9, wherein the seal member seals the predetermined space on the case member side and seals a space between the flow path portion and the seal member.

11. A liquid ejecting apparatus in accordance with claim 9, wherein a seal part of the seal member has a groove-shaped path open to an atmosphere.

12. A liquid ejecting apparatus in accordance with claim 9, wherein the seal member is formed of an elastomer.

13. A liquid ejecting apparatus in accordance with claim 9, the liquid ejecting head further comprising:

a flexible substrate that is connected to the head chip; and a circuit substrate that is connected to the flexible substrate, wherein the seal member has a seal part that is pinched by the circuit substrate and the flow path portion, and wherein the circuit substrate extends to a further outer side than a position of sealing by the seal part and a circuit that is connected to the flexible substrate is on a further outer side than the sealing position as a pattern.

14. A liquid ejecting apparatus in accordance with claim 13, the liquid ejecting head further comprising a circuit substrate that is electrically connected with the head chip, wherein the seal member has a seal part that is pinched by the circuit substrate and the flow path portion, wherein the seal part of the seal member on a circuit substrate side has a planar shape, and wherein silk printing is performed on a part of the circuit substrate in contact with the seal part to smoothen unevenness of a circuit substrate surface.

15. A liquid ejecting apparatus in accordance with claim 13, wherein the case member has a receiving portion that pinches the circuit substrate with the seal part of the seal member.

16. A liquid ejecting apparatus in accordance with claim 9, wherein the seal member is formed into a plate shape laminated with the flow path portion, wherein the seal member hermetically seals the predetermined space on the case member side with a seal part on the case member side, wherein the seal member seals the space between the flow path portion and the seal member, wherein the seal member has a groove-shaped path open to an atmosphere in a seal part on a flow path portion side, and wherein the seal member allows the predetermined space on the case member side and the space between the flow path portion and the seal member to communicate with each other.

* * * * *